US007717762B2

(12) United States Patent
Boatman et al.

(10) Patent No.: US 7,717,762 B2
(45) Date of Patent: May 18, 2010

(54) DETACHABLE MOORING SYSTEM WITH BEARINGS MOUNTED ON SUBMERGED BUOY

(75) Inventors: L. Terry Boatman, Spice Wood, TX (US); Stephen P. Lindblade, Waller, TX (US)

(73) Assignee: SOFEC, Inc., Houston, TX (US)

( * ) Notice: Subject to any disclaimer, the term of this patent is extended or adjusted under 35 U.S.C. 154(b) by 3 days.

(21) Appl. No.: 11/707,479

(22) Filed: Feb. 16, 2007

(65) Prior Publication Data

US 2007/0264889 A1 Nov. 15, 2007

Related U.S. Application Data

(60) Provisional application No. 60/794,469, filed on Apr. 24, 2006.

(51) Int. Cl.
*B63B 21/50* (2006.01)
*B63B 22/02* (2006.01)

(52) U.S. Cl. ..... 441/3; 114/230.1; 114/230.12; 441/5

(58) Field of Classification Search ..... 114/230.1, 114/230.12, 293; 441/3–5
See application file for complete search history.

(56) References Cited

U.S. PATENT DOCUMENTS 3,440,671 A * 4/1969 Smulders ..... 441/5
3,742,536 A * 7/1973 Sada et al. ..... 441/5
4,637,336 A * 1/1987 Engelskirchen ..... 114/293
4,753,553 A * 6/1988 Carlsen et al. ..... 405/195.1
4,802,431 A 2/1989 Pollack
4,892,495 A 1/1990 Svensen
5,044,297 A 9/1991 de Baan et al.
5,065,689 A 11/1991 Krogstad
5,240,446 A * 8/1993 Boatman et al. ..... 441/3
5,305,703 A 4/1994 Korsgaard
5,339,760 A 8/1994 Korsgaard
5,363,789 A 11/1994 Laurie et al.
5,380,229 A 1/1995 Korsgaard
5,456,622 A 10/1995 Breivik et al.
5,468,166 A 11/1995 Breivik et al.
5,509,838 A * 4/1996 Breivik et al. ..... 441/5
5,529,521 A 6/1996 Breivik et al.

(Continued)

FOREIGN PATENT DOCUMENTS

GB 2273087 A * 6/1994

*Primary Examiner*—Ajay Vasudeva
(74) *Attorney, Agent, or Firm*—Gary L. Bush; Andrews Kurth LLP

(57) ABSTRACT

A mooring system comprising a submerged buoy releasably connectable to a vessel keel having a combined axial/radial bearing. A segmented ring, fastened to the buoy, forms the bearing outer ring. An inner bearing hub slidingly carried on the bearing outer ring is connectable to a vessel structural connector. In a first embodiment, the structural connector includes an inner cylindrical sleeve coaxially movable within an outer cylindrical housing by circumferential actuators. The lower ends of the connector sleeve and connector housing capture plural collet segments circumpositioned therebetween that radially move in and out as the connector sleeve is moved axially within the connector housing. The lower ends of the collet segments extend downward into the bearing hub and releasably engage an interior groove therein, thereby dogging the bearing hub against the vessel. In a second embodiment, the bearing hub is simply bolted directly to a cylindrical connector member of the vessel.

19 Claims, 17 Drawing Sheets

U.S. PATENT DOCUMENTS 5,540,607 A 7/1996 Breivik et al.
5,545,065 A 8/1996 Breivik et al.
5,564,957 A 10/1996 Breivik et al.
5,628,657 A 5/1997 Breivik et al.
5,651,708 A 7/1997 Børseth
5,697,732 A 12/1997 Sigmundstad
5,749,758 A 5/1998 Breivik et al.
5,820,429 A * 10/1998 Smedal et al. ..... 441/5
5,839,387 A 11/1998 Myklebust
5,913,279 A 6/1999 Braud et al.
5,941,746 A 8/1999 Isnard et al.
5,951,345 A 9/1999 Perratone et al.
5,957,074 A 9/1999 de Baan et al.
5,957,076 A 9/1999 Pollack et al.
5,983,931 A 11/1999 Ingebrigtsen et al.
6,053,787 A 4/2000 Erstad et al.
6,070,548 A 6/2000 Ducousso et al.
6,155,193 A 12/2000 Syvertsen et al.
6,164,233 A 12/2000 Pollack et al.
6,176,193 B1 1/2001 Whitby et al.
6,199,500 B1 3/2001 Børseth et al.
6,200,180 B1 3/2001 Hooper
6,250,243 B1 6/2001 Wierli et al.
6,269,762 B1 8/2001 Commandeur
6,302,048 B1 10/2001 Smedal
6,315,625 B1 11/2001 Braud
6,474,252 B1 11/2002 Delago
6,502,524 B1 1/2003 Hooper
6,517,290 B1 2/2003 Poldervaart
6,543,376 B1 4/2003 Breivik et al.
6,595,154 B2 * 7/2003 Boatman ..... 114/230.12
6,701,981 B1 3/2004 Olsen
6,736,082 B2 5/2004 Breivik et al.
2004/0029464 A1 2/2004 Pollack et al.

* cited by examiner

DETACHABLE MOORING SYSTEM WITH BEARINGS MOUNTED ON SUBMERGED BUOY

CROSS REFERENCE TO RELATED APPLICATION

This application is based upon provisional application 60/794,469 filed on Apr. 24, 2006, the priority of which is claimed.

BACKGROUND OF THE INVENTION

1. Field of the Invention

This invention concerns detachable mooring systems for loading and offloading liquid petroleum product oil tankers, floating storage (FSO) vessels, floating production storage and offloading (FPSO) systems, floating vessels for natural gas offloading (for example, cryogenic liquefied natural gas (LNG) regas import terminals), and LNG transport vessels.

2. Description of the Prior Art

Numerous patents are known that pertain to disconnectable mooring systems, many of which provide a submerged buoy that can be detachably released from a floating vessel. For example, U.S. Pat. No. 5,651,708 issued to Borseth shows a detachable buoy with a geostationary part. The Borseth buoy has an outer body that is received in a recess in the bottom of the vessel, where the outer body is fixed to the vessel by locking wedges. Four other notable types of detachable mooring systems are known and are illustrated in FIGS. 1 to 4.

FIGS. 1A and 1B illustrate a disconnectable mooring system of a design of FMC Technologies and as illustrated by U.S. Pat. No. 5,240,446. The mooring system includes two basic parts—a geostationary buoy (61) that is detachably connectable to a turret assembly (53) that is disposed in the floating vessel. The buoy (61) is moored to the seabed by a number of anchor legs (63) that are connected to the buoy at anchor leg connectors (62), such that the buoy is generally geostationary.

The vessel (52) carries a turret assembly (53), which is revolvably disposed within the vessel hull and which opens to the sea near the keel elevation. The turret (53) includes a vertical turret shaft (59) and is supported by an upper axial bearing (57) and a lower radial bearing (58). The turret and bearings remain on the vessel when the buoy is disconnected therefrom. The lower end of the turret shaft (59) is equipped with a structural connector (60) that is designed and arranged to disconnectably mate with a connector hub (66) located at the upper surface of the buoy (61). Rubber fenders (64) are provided on the buoy to cushion the mooring process, and a water seal (67) is provided to maintain watertight integrity of the turret compartment in the vessel.

The turret mooring arrangement of FIGS. 1A and 1B provides a fluid flow path between a subsea well or component and the vessel when the vessel is moored to the buoy. The fluid transfer system (FTS) (54) includes a flexible conductor (68) spanning the distance between the seabed and the buoy (61), a lower conductor pipe (56*a*) that is geostationary and in fluid communication with the flexible conductor, and an upper conductor pipe (56*b*), which is fixed to the vessel and in fluid communication with the lower conductor pipe (56*a*) via a fluid swivel (55).

When the buoy (61) is completely separated from the vessel (52), the buoy (61) is designed and arranged to sink to a neutrally buoyant position about 36 meters below sea level. As shown in FIG. 1B, the vessel is moored to the buoy by first recovering the submerged buoy upwards to the structural connector (60) by heaving in a retrieval line (65) with a winch system (not shown). The structural connector (60) is then locked in engagement with the connector hub (66), fixing the turret with the geostationary buoy and mooring the vessel (52) to the seabed. The vessel can freely weathervane about the geostationary turret in response to wind, waves and currents.

FIGS. 2A and 2B show a later version of a disconnectable turret mooring arrangement (71) design of FMC Technologies. The turret mooring arrangement (71) of FIGS. 2A and 2B is substantially similar to the turret mooring arrangement (51) of FIGS. 1A and 1B. For example, the buoy (81) is moored to the seabed by a number of anchor legs (83) that are connected to the buoy at anchor leg connectors (82), such that the buoy is generally geostationary. The vessel (72) carries a turret assembly (73), which is revolvably disposed within the vessel hull and which opens to the sea near the keel. The turret assembly (73) includes a vertical turret shaft (79) and is supported by an upper axial bearing (77) and a lower radial bearing (78). The turret and bearings remain on the vessel when the buoy is disconnected. The lower end of the turret shaft (79) is equipped with a structural connector (80) that is designed and arranged to disconnectably mate with a connector hub (86) disposed at the upper surface of the buoy (81). A water seal (87) is provided to maintain watertight integrity of the turret compartment in the vessel. The fluid transfer system (FTS) (74) includes a flexible conductor (88) between the seabed and the buoy (81), a lower geostationary conductor pipe (76*b*) in fluid communication with the flexible conductor, and an upper conductor pipe (76*a*), fixed to the vessel and in fluid communication with the lower conductor pipe (76*b*) via a fluid swivel (75). When the buoy (81) is separated from the vessel (72), the buoy (81) is designed and arranged to sink to a neutrally buoyant position about 36 meters below sea level. A retrieval line (85) is provided for heaving the buoy to the vessel.

However, unlike the turret mooring arrangement of FIGS. 1A and 1B, where the buoy (61) abuts the keel of the moored vessel (52), in the arrangement of FIGS. 2A and 2B, the upper part of a buoy (81) is cone shaped and is brought into a cone shaped buoy receiving space (89). The structural connector (80) fastens the buoy (81) to the turret shaft (79). The turret shaft (79) is rotatively connected to the vessel (72) by the upper bearing (77). The skirt 90 is rotatively coupled to the lower bearing (78). This system typically is used when several large fluid conductors (88) are required.

FIGS. 3A and 3B generally describe a subsurface buoy mooring system (101) such as that shown by Svensen in U.S. Pat. No. 4,892,495. A cone-shaped buoy (103) is rotatably received into a receptacle (108) formed in the vessel hull (111) and is secured inside a complementary turret receptacle (104) by latches (105). A radial bearing (106) and a vertically-oriented axial bearing (107) support turret (102). The axial bearing (107) abuts a bearing support surface (110). When the buoy (103) is disconnected from the vessel, the turret and the bearings remain on the vessel. The buoy (103) is moored to the seabed by a number of anchor legs (109) such that it is essentially geostationary. For simplicity, the fluid transfer system is not illustrated.

FIGS. 4A and 4B illustrate a type of mooring system (121) design of Advanced Production Loading (APL) AS of Norway and described in U.S. Pat. No. 5,468,166, among others. A buoy assembly (124) includes a buoy (128), upper and lower bearings (126, 127), and a turret (125) that is rotatably supported by the bearings. The cone-shaped buoy (128) is non-rotatably secured into a complementary receptacle (137)

formed in the vessel hull (122) by latches (134) that engage a groove (135) formed in the buoy.

The fluid transfer system (FTS) includes a flexible conductor (133) spanning the distance between the seabed and the buoy (128), a lower conductor pipe (132) that is geostationary and in fluid communication with the flexible conductor, and an upper conductor pipe (136), which is fixed to the vessel and in fluid communication with the lower conductor pipe (132) via a fluid swivel (123).

However, the buoy (128) is not geostationary; the buoy is attached to and rotates with the vessel hull (122) while the turret (125) remains geostationary. When the buoy assembly (124) is disconnected from the vessel (122), the bearings and the turret remain on the buoy. The lower end of the turret (125) forms a chain table or anchor leg frame (129) with anchor leg connectors (131). A number of anchor legs (130) connect the turret to the seabed so that the turret (125) is essentially geostationary. In this design the entire anchor leg system weight and loads are supported by the axial bearing (126). Because the APL buoy (128) is secured directly to the vessel (122), its buoyancy does not serve to reduce vertical bearing loads.

Most mooring systems are "turret" systems of one form or another which are familiar to those skilled in the art. Turrets are generally large and expensive structures that usually include large diameter upper and lower bearings. Many prior art disconnectable mooring systems also require a large (approximately 10 meters diameter or larger) cone shaped opening in the vessel bottom. Such structure mandates expensive vessel construction. Because there is a continuing requirement for lowering the cost of major components on floating production systems and loading/offloading cargo vessels, reduction of large, expensive mooring structures is advantageous. Furthermore, large openings in the vessel hull to accommodate mooring buoys cause significant drag and energy losses on those disconnectable cargo vessels when they are sailing long distances. As newer and larger high speed LNG carrier/regas vessels tend to have a narrow flat bottom near the bow at the optimum location for a buoy connection, a large hull opening is less desirable in these applications.

3. Identification of Objects of the Invention

A primary object of the invention is to provide a mooring buoy that remains geostationary with only an inner ring of a bearing mounted on the buoy that can be disconnectably connected to the ship.

Another primary object of this invention is to provide a detachable mooring system in which a bearing can be installed in or on the buoy that has a large radial mooring load capacity due to its unique arrangement. Detachable moorings having larger load capacity are desirable because hydrocarbon production and import/export terminals are moving into more hostile environments.

Another object of the invention is to provide a mooring system that requires a significantly smaller opening in the vessel with the capability to plug the opening so a virtually smooth ship bottom is achieved at the buoy connection point.

Another object of the invention is to provide an improved disconnectable mooring system that eliminates the need for the turret component of prior loading and offloading liquid petroleum product oil tankers, floating storage (FSO) vessels, floating production storage and offloading (FPSO) systems, floating vessels for natural gas offloading, and LNG transport vessels, thereby resulting in significant cost reductions.

Another object of the invention is to provide an improved detachable mooring system that can be released and recovered in high sea states and harsh conditions due to the arrangement of buoy to ship interface equipment.

Another object of the invention is to provide an adaptation of the invention that achieves the inherent cost and functional advantages of the new arrangement for mooring a vessel permanently installed at an offshore location.

SUMMARY OF THE INVENTION

The objects identified above, as well as other features and advantages of the invention are incorporated in a mooring and fluid transfer system including a submergible buoy that is moored to the sea floor so as to be generally geostationary. The buoy can be detached from a floating vessel. The buoy mounts adjacent the bottom of the vessel rather than having a substantial portion of the buoy being received into the vessel as disclosed by the prior art FIGS. 2-4. A combined bearing assembly that supports axial and radial loading is mounted on the buoy, rather than in the vessel as disclosed by the prior art FIGS. 1-3.

A cylindrical bearing hub, which forms an inner ring of a bearing assembly, is rotatively mounted to a segmented ring that forms the outer ring of the bearing assembly, which is ideally fastened to the buoy hull with bolts. The bearing hub can be releasably connected to the bottom of the vessel by a structural connector on board the vessel. The bearing assembly is structured so that radial bearing loads pass between the vessel and the buoy directly through the bearing hub, radial bushing segments, and a bushing seat formed in the buoy. The outer bearing ring and mounting bolts carry only axial loads; no radial loading passes through bolts. The multi-piece segmented structure of the outer bearing ring reduces bearing weight.

In a first embodiment, the vessel includes a structural connector which includes an inner cylindrical sleeve coaxially disposed in an outer cylindrical housing. The inner sleeve can be axially moved within the outer housing by a number of actuators which are circumferentially disposed between the sleeve and the housing. The lower ends of the connector sleeve and connector housing capture a number of collet segments circumpositioned therebetween that radially pivot in and out as the inner connector sleeve is moved axially up and down within the connector housing. To connect the mooring buoy to the vessel, the bearing hub of the buoy is placed axially adjacent the bottom of the connector housing of the vessel's structural connector. The lower ends of the collet segments extend downward into the interior of the bearing hub. The connector sleeve is moved downward by the actuators, which forces the lower ends of the collet segments to pivot radially outward. The ends of the collet segments then engage an interior groove in the bearing hub, thus dogging the bearing hub (and the buoy) against the connector housing of the vessel.

In a second embodiment, the bearing hub is simply bolted directly to a cylindrical connector member of the vessel.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 5A:
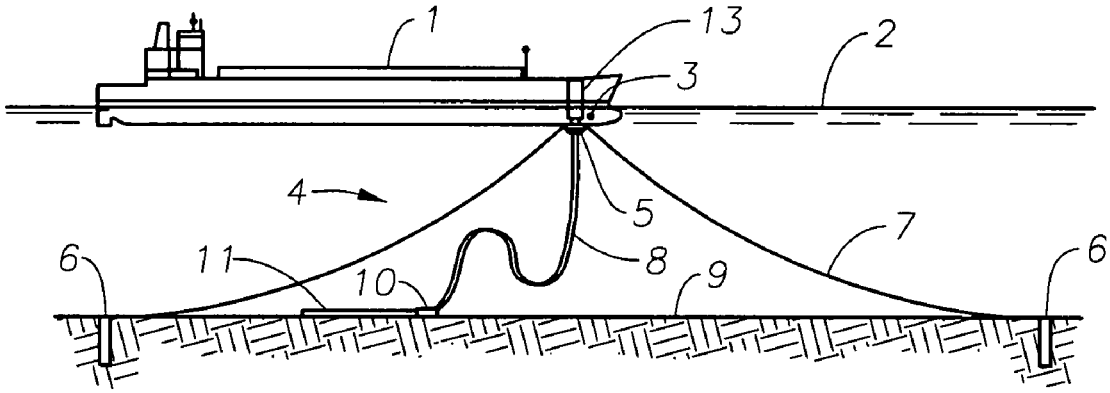
FIG. 5A is a side view of a floating cargo tanker ship moored to a disconnectable geostationary buoy according to an embodiment of the invention.
Figure 5B:
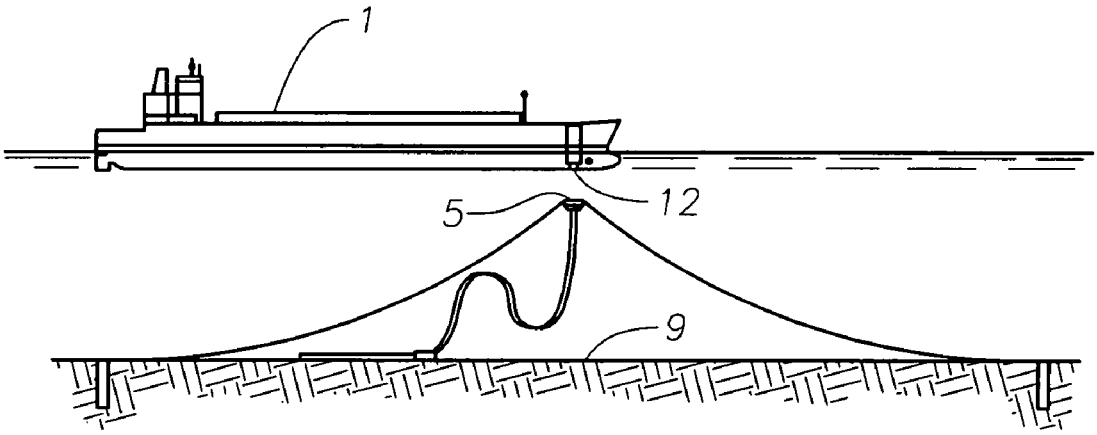
FIG. 5B is a side view of the cargo tanker ship of FIG. 5A disconnected from the buoy of FIG. 5A.

FIGS. 5A and 5B illustrate an embodiment of the invention used for mooring a cargo tanker ship 1 that is adapted for transporting liquid or pressurized gas hydrocarbon products. Tanker 1 typically requires frequent connection and disconnection from the mooring system and may be equipped with bow thrusters 3 to aid the recurring mooring process.

Mooring system 4, generally consisting of a geostationary buoy 5 that is detachably connectable to a structural connector 12 mounted to the bottom of the vessel 1, is adapted to temporarily moor the vessel, allowing the vessel to weathervane around the point of mooring under the influence of wind, waves and currents while it is being loaded. Mooring system 4 preferably includes a number of anchors 6 and anchor legs 7 that moor buoy 5 to the sea floor 9 so that the buoy is essentially geostationary.

The structural connector 12, fixed to vessel 1, is locked in axial engagement with the buoy but is free to rotate about the geostationary buoy. Mooring arrangement 4 provides a fluid flow path between a subsea well, pipeline, or component and the vessel when the vessel is moored to the buoy. The cargo is transported to or from ship 1 by pipeline 11 on seafloor 9, pipeline end manifold (PLEM) 10, flexible conductor 8, and fluid transfer system 13, located on ship 1. However, other fluid flow paths arrangements may be used as appropriate.

Figure 1B:
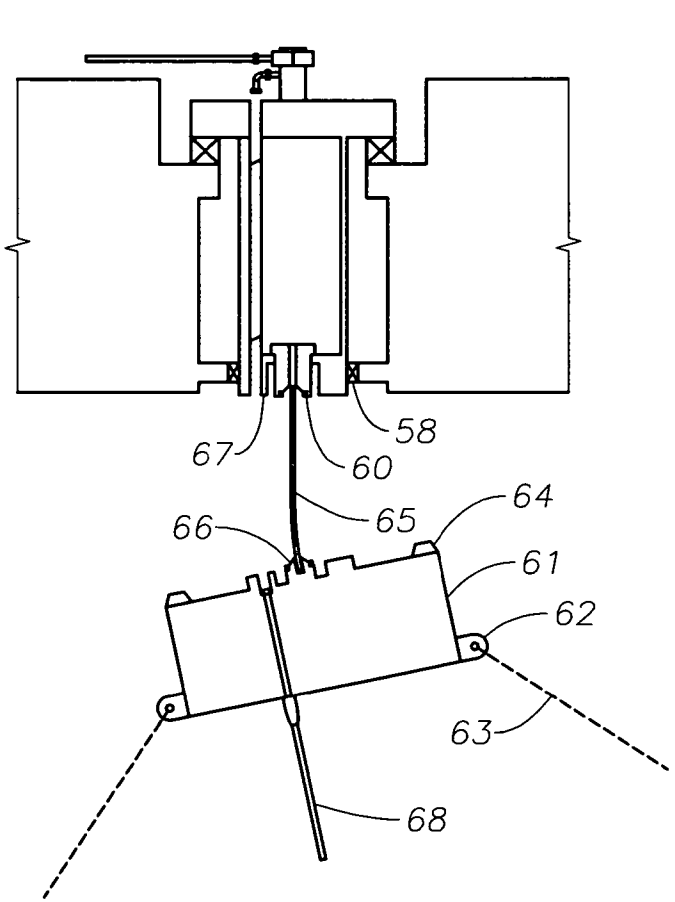
Fig. 1B (Prior Art)
FIG. 1B is a side view in partial cross section of the prior art disconnectable mooring system of FIG. 1A showing the mooring buoy disconnected from the vessel in the process of mooring.
Figure 1A:
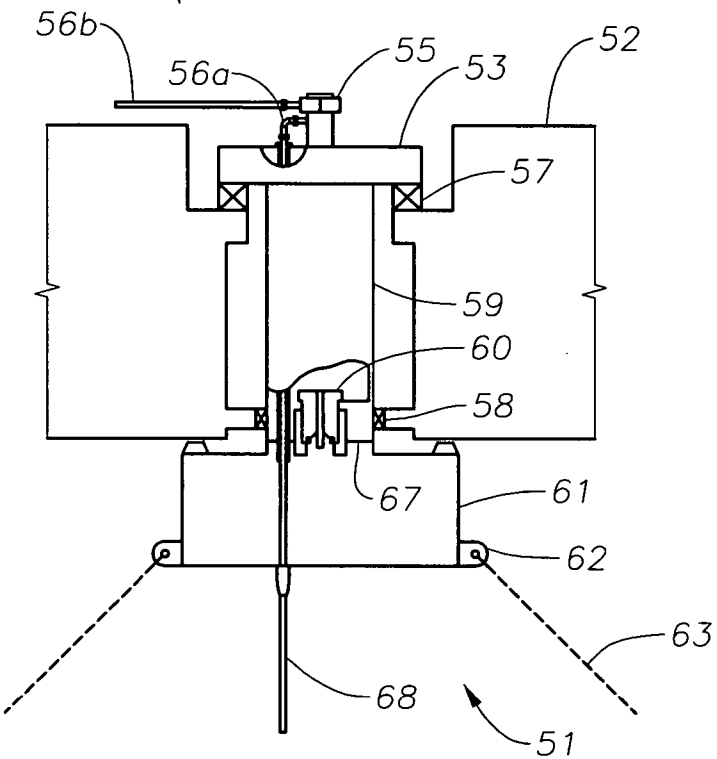
Fig. 1A (Prior Art)
FIG. 1A is a side view in partial cross section of a disconnectable mooring system of prior art showing a mooring buoy connected to a vessel and a fluid transfer system.
Figure 2B:
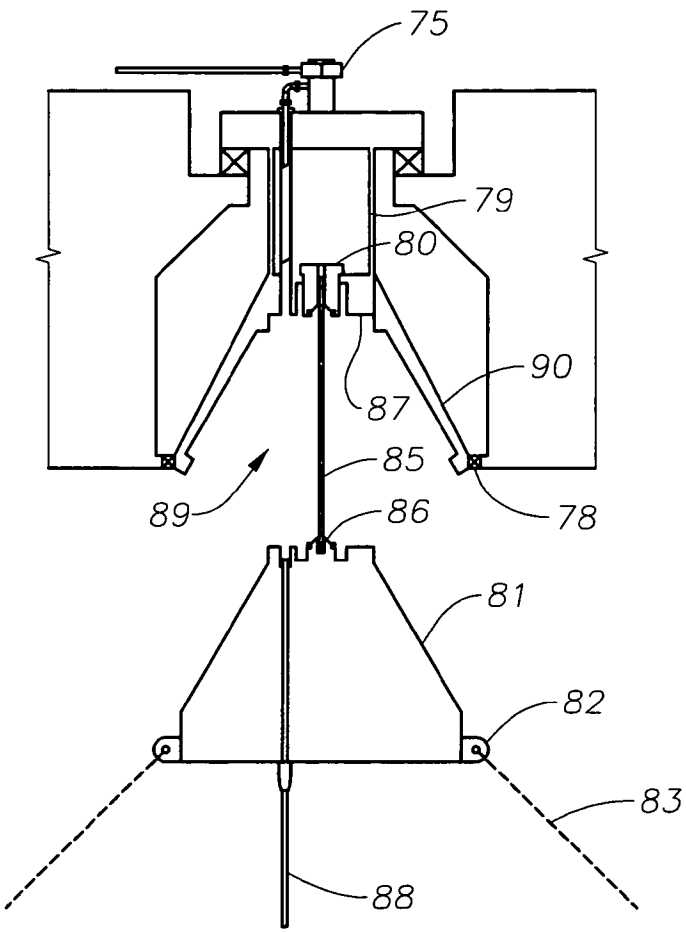
Fig. 2B (Prior Art)
FIG. 2B is a side view in partial cross section of the prior art disconnectable mooring system of FIG. 2A showing the mooring buoy disconnected from the vessel in the process of mooring.
Figure 2A:
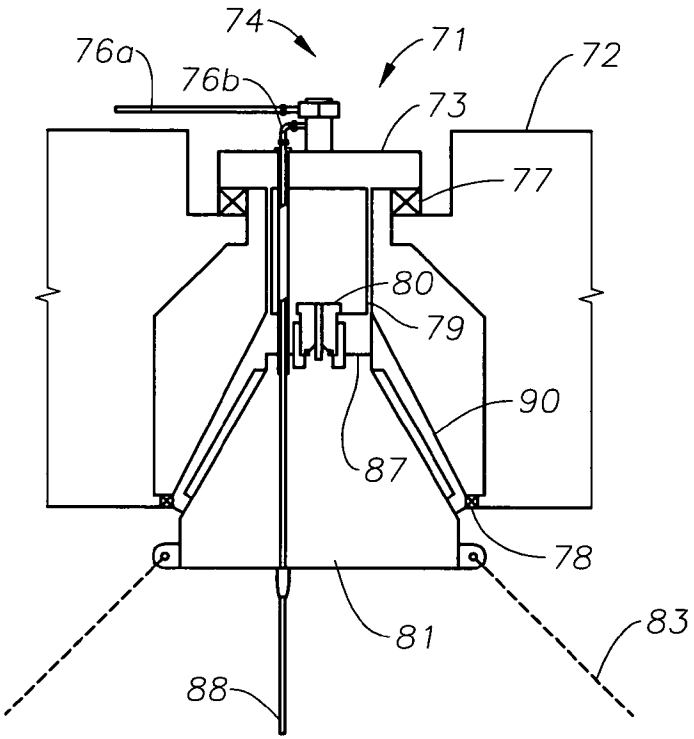
Fig. 2A (Prior Art)
FIG. 2A is a side view in partial cross section of a later disconnectable mooring system of prior art showing a mooring buoy connected to a vessel and a fluid transfer system.
Figure 3B:
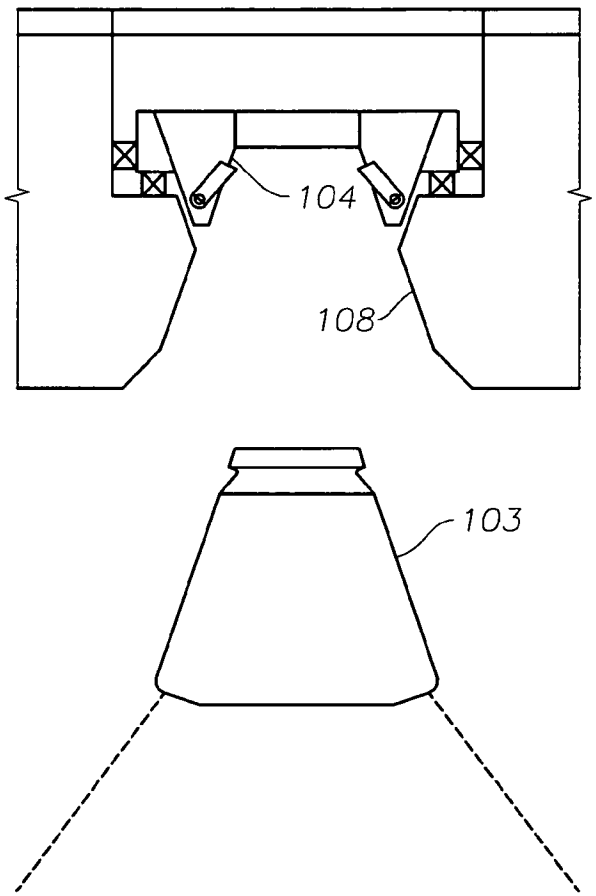
Fig. 3B (Prior Art)
FIG. 3B is a side view in partial cross section of the prior art disconnectable subsurface buoy mooring system of FIG. 3A showing the mooring buoy disconnected from the vessel.
Figure 3A:
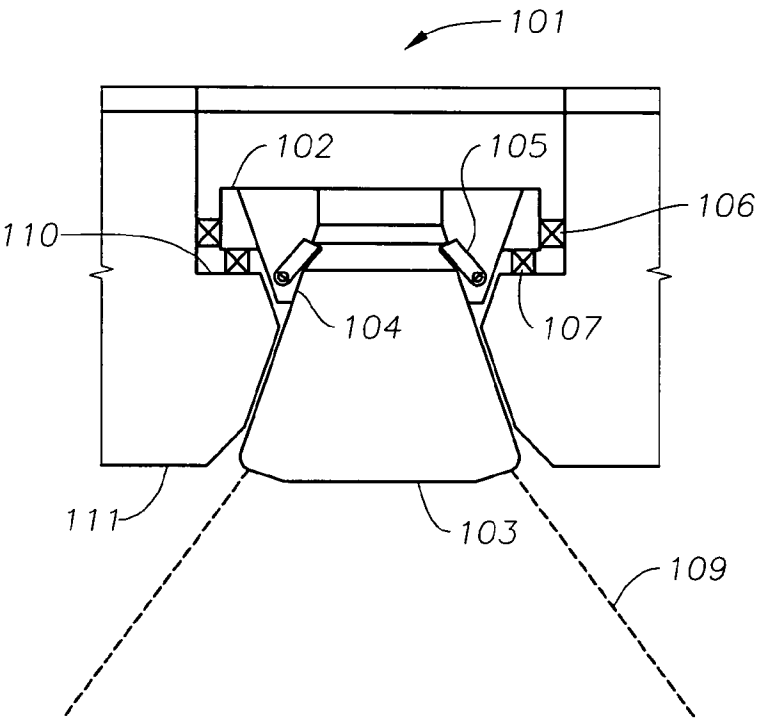
Fig. 3A (Prior Art)
FIG. 3A is a side view in partial cross section of a disconnectable subsurface buoy mooring system of prior art showing a mooring buoy connected to a vessel.
Figure 4B:
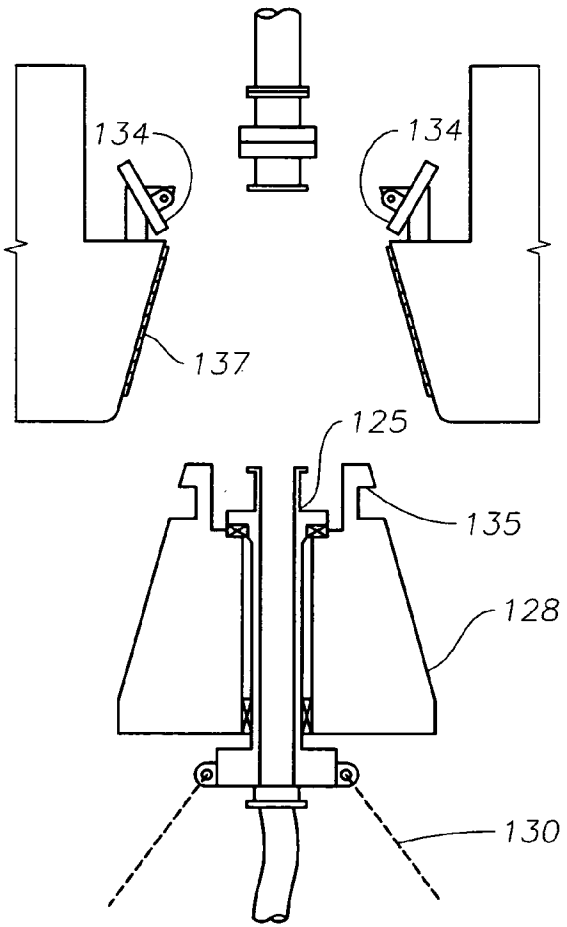
Fig. 4B (Prior Art)
FIG. 4B is a side view in partial cross section of the prior art disconnectable mooring system of FIG. 4A showing the mooring buoy disconnected from the vessel.
Figure 4A:
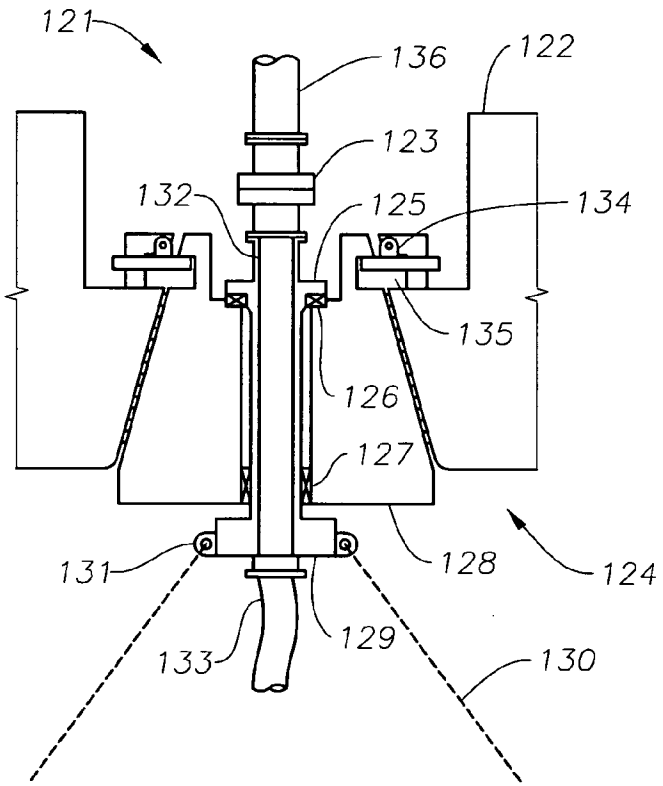
Fig. 4A (Prior Art)
FIG. 4A is a side view in partial cross section of a disconnectable mooring system of prior art showing a mooring buoy with an onboard turret connected to a vessel.

FIG. 5B shows ship 1 disconnected from buoy 5. Structural connector 12 remains on the ship. When the buoy 5 is completely detached from the vessel 1, the buoy 5 is designed and arranged to sink to a neutrally buoyant position about 36 meters below sea level 2. Unlike the mooring arrangements of FIGS. 1-3, the vessel 1 used with mooring system 4 does not carry a turret assembly revolvably disposed within the vessel hull. Neither axial bearings nor radial bearings remain on the vessel when the buoy is disconnected therefrom.

Figure 6A:
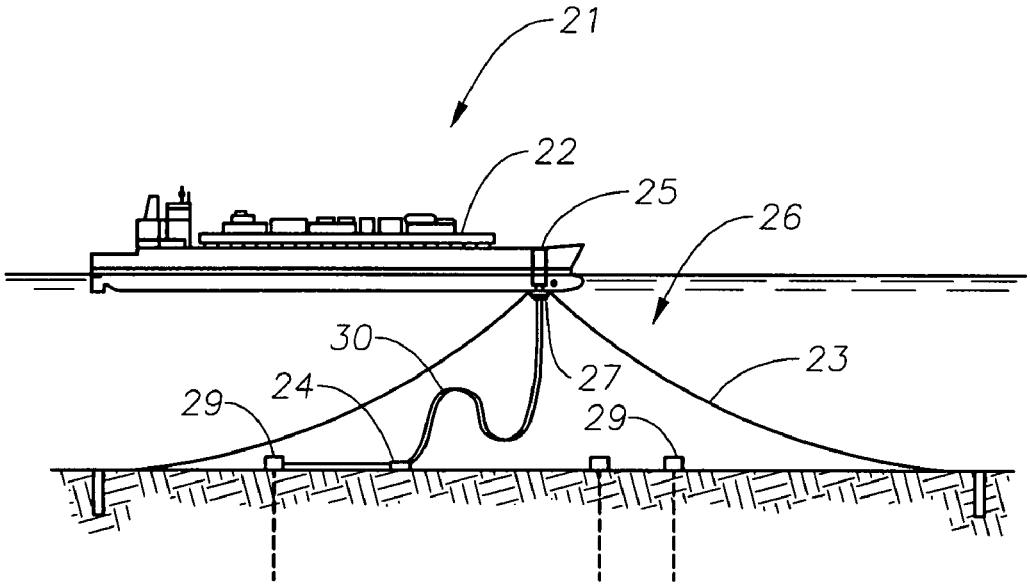
FIG. 6A is a side view of a floating production system moored by a detachable buoy according to an embodiment of the invention.
Figure 6B:
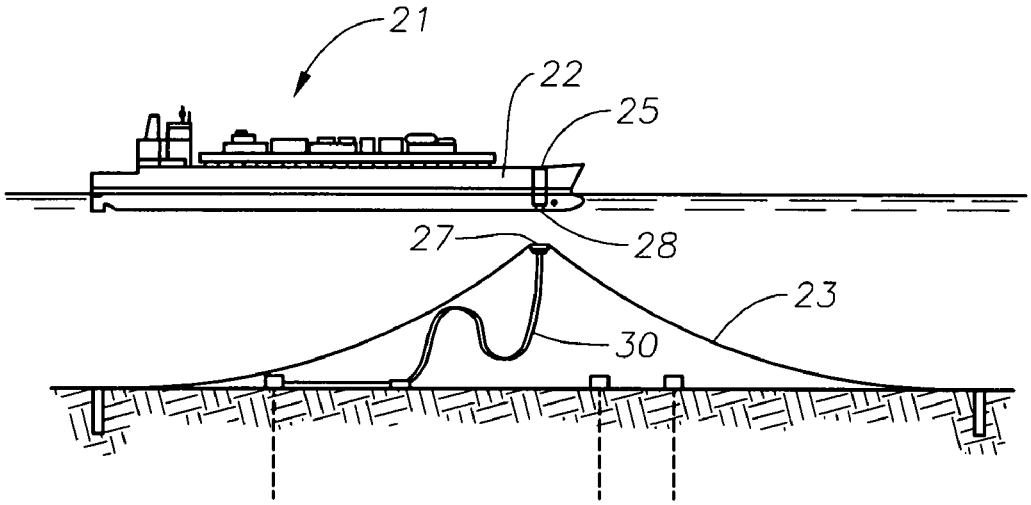
FIG. 6B is a side view of the floating production system of FIG. 6A disconnected from the buoy of FIG. 6A.

FIGS. 6A and 6B illustrate an embodiment of the invention used for mooring a floating production, storage, and offloading (FPSO) vessel 22. Production system 21 may be installed on vessel 22. This type system does not require frequent or rapid disconnection from the buoy. Disconnection and reconnection of this type system generally is done in fairly calm water conditions, but may occur in deteriorating weather conditions from an approaching hurricane. Advantages of quicker construction, less capital expense, and rapid offshore installation of the mooring system are provided by the invention.

Mooring system 26, generally consisting of a geostationary buoy 27 that is detachably connectable to a structural connector 28 mounted to the bottom of the vessel 22, is adapted to moor the vessel, allowing the vessel to weathervane around the point of mooring under the influence of wind, waves and currents. Mooring system 26 preferably includes a number of anchors and anchor legs 23 that moor buoy 27 to the sea floor so that the buoy is essentially geostationary.

In FIG. 6A, the structural connector 28, fixed to vessel 22, is locked in axial engagement with the buoy but is free to rotate about the geostationary buoy. Mooring arrangement 26 provides a fluid flow path between a subsea well 29 and the vessel when the vessel is moored to the buoy. Fluid is transported to FPSO 22 from the subsea well by a subsea manifold 24, flexible conductor 30 and fluid transfer system 25, located on FPSO 22. However, other fluid flow paths arrangements may be used as appropriate.

FIG. 6B shows FPSO 22 disconnected from buoy 27. Structural connector 28 remains on the vessel. When the buoy 27 is completely detached from the vessel 22, the buoy 27 is designed and arranged to sink to a neutrally buoyant position about 36 meters below sea level. Unlike the mooring arrangements of FIGS. 1-3, the vessel 22 used with mooring system 26 does not carry a turret assembly about which the vessel can revolve. Neither axial bearings nor radial bearings remain on the vessel when the buoy is disconnected therefrom.

Figure 7A:
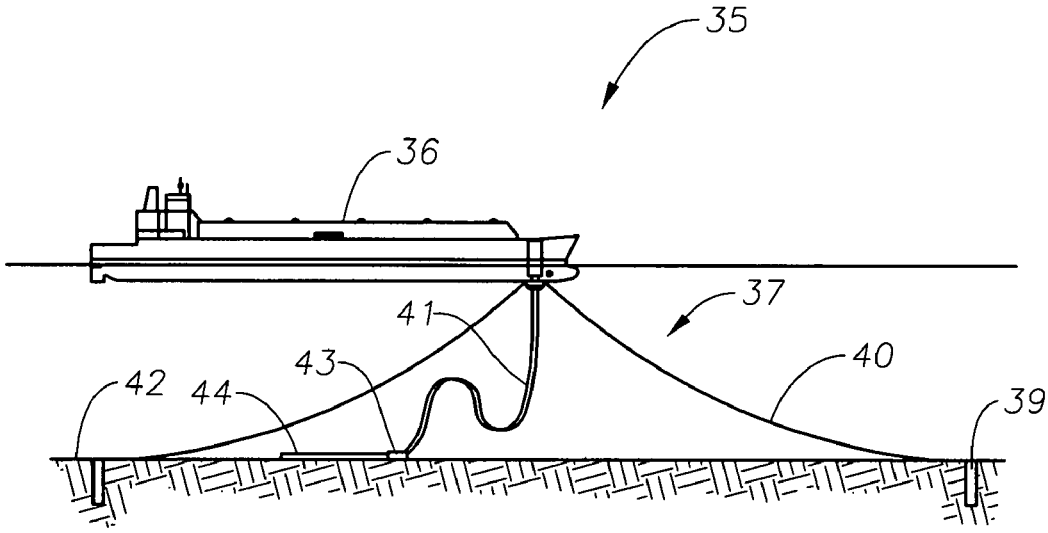
FIG. 7A is a side view of a floating LNG import/export terminal moored to a disconnectable geostationary buoy according to an embodiment of the invention.
Figure 7B:
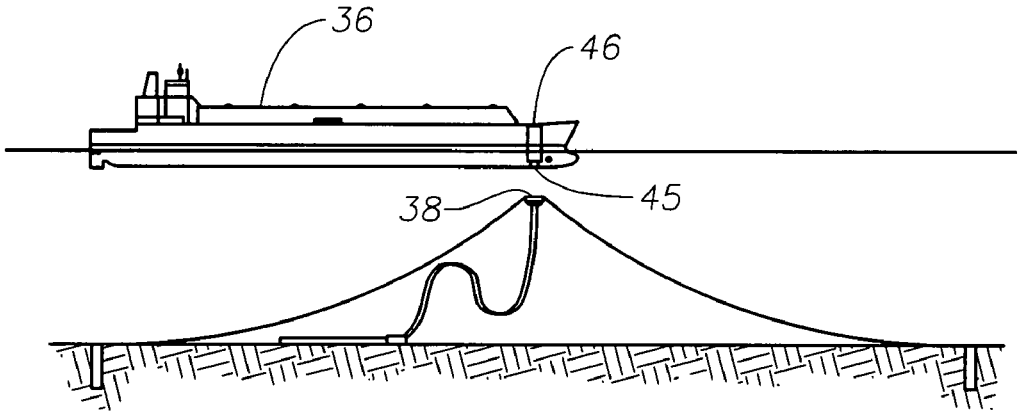
FIG. 7B is a side view of the LNG import/export terminal of FIG. 7A disconnected from the buoy of FIG. 7A.

FIGS. 7A and 7B illustrate an embodiment of the invention used with an LNG import/export terminal 35 including an LNG regas ship 36 that loads or offloads LNG cargo through flexible conductor 41. Mooring system 37, generally consisting of a geostationary buoy 38 that is detachably connectable to a structural connector 45 mounted to the bottom of the vessel 36, is adapted to moor the vessel, allowing the vessel to weathervane around the point of mooring under the influence of wind, waves and currents. Mooring system 37 preferably includes a number of anchors 39 and anchor legs 40 that moor buoy 38 to the sea floor 42 so that the buoy is essentially geostationary.

In FIG. 7A, the structural connector 45, fixed to vessel 36, is locked in axial engagement with the buoy but is free to rotate about the geostationary buoy. Mooring arrangement 37 provides a fluid flow path between a pipeline or component and the vessel when the vessel is moored to the buoy. Fluid is transported to or from LNG carrier ship 36 by pipeline 44 on seafloor 42, pipeline end manifold (PLEM) 43, flexible conductor 41, and fluid transfer system 46, located on vessel 36. However, other fluid flow paths arrangements may be used as appropriate.

FIG. 7B shows LNG carrier ship 36 disconnected from buoy 38. Structural connector 45 remains on the ship. When the buoy 38 is completely detached from the vessel 36, the buoy 38 is designed and arranged to sink to a neutrally buoyant position about 36 meters below sea level. Unlike the mooring arrangements of FIGS. 1-3, the vessel 36 used with mooring system 37 does not carry a turret assembly revolvably disposed within the vessel hull. Neither axial bearings nor radial bearings remain on the vessel when the buoy is disconnected therefrom.

Figure 8:
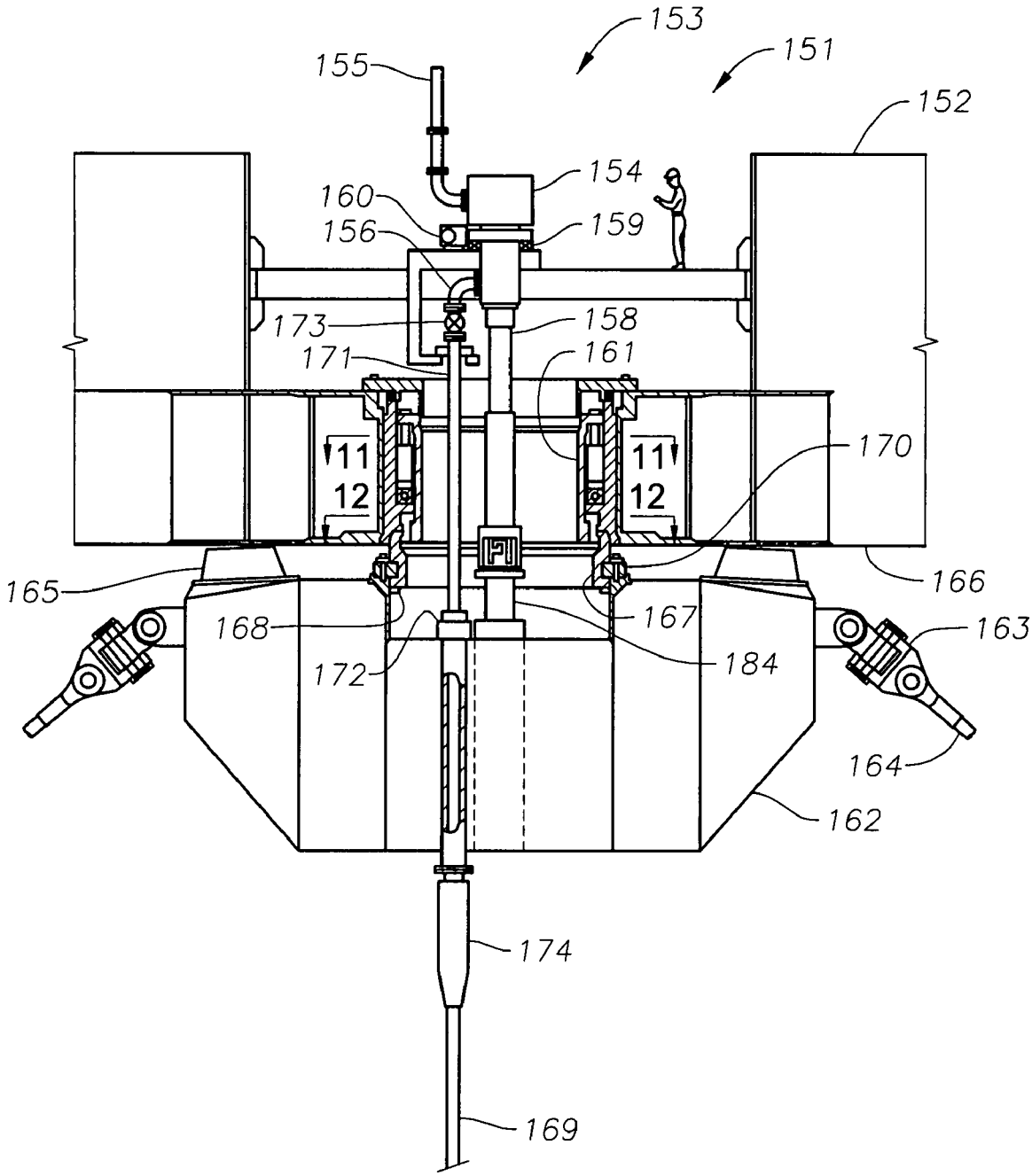
FIG. 8 is a side view in partial cross section of a mooring and fluid transfer system according to a preferred embodiment of the invention.

FIG. 8 illustrates the improved mooring and fluid transfer system 151 of the invention in partial cross-section according to a preferred embodiment. Detachable buoy 162 is rotatively fastened to the keel 166 of vessel 152 by bearing hub 167, buoy bearing 170, and structural connecter 161. Rubber fenders 165 are provided on buoy 162 to cushion the mooring process, and a water seal 168 is provided to maintain watertight integrity of the vessel fluid transfer system (FTS) compartment. Buoy 162 is geostationarily moored above the sea floor by anchor legs 164 and anchor leg connectors 163. Center post 184 serves the dual purpose of driving swivel torque tube 158 and providing the attachment point for pulling head 182 as shown in FIG. 9.

A flexible fluid conduit 169 is suspended by buoy 162 to provide a fluid flow path between a subsea well, pipeline or component and vessel 152, when moored to buoy 162. Bend restrictor 174 is preferably disposed about flexible conduit 169 at the buoy/conduit interface to prevent bend radii of flexible conduit 169 smaller than allowable limits. Flexible conductor 169 connects to the vessel fluid transfer system (FTS) 153. The fluid path of FTS 153 includes fluid swivel 154, upper flexible conductor 155, conductor elbow 156, isolation valve 173, and geostationary conductor 171. Conductor water seal 172 is provided to maintain watertight integrity of the vessel FTS compartment. The axial geostationary part of swivel 154 is attached to buoy 162 by torque tube 158. The weight of swivel 154 and the geostationary fluid conductors 156, 173, 171 and 169 are carried by swivel bearing 159. A swivel rotary drive 160 is also provided.

Figure 9A:
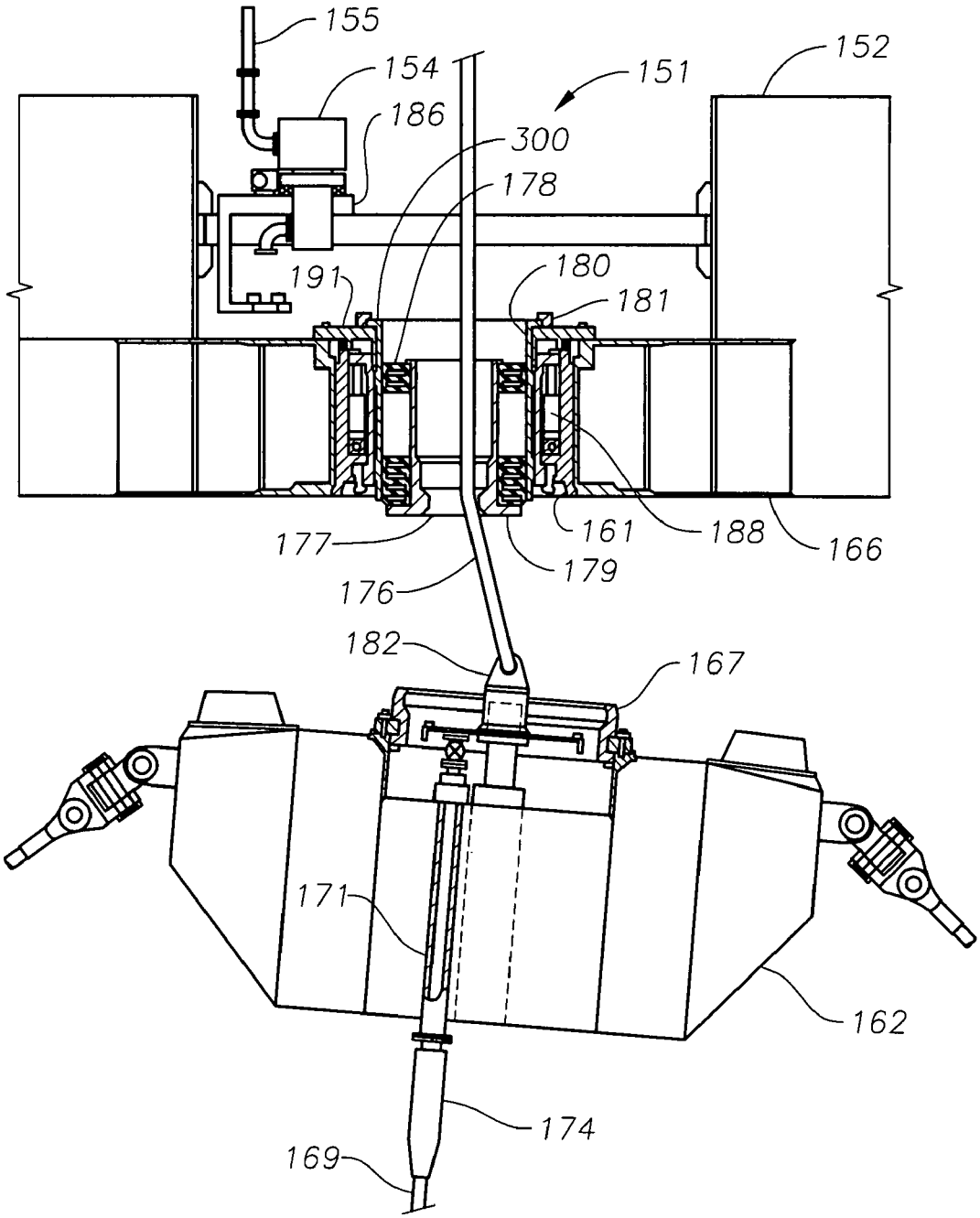
FIG. 9A is a side view in partial cross section of the mooring and fluid transfer system of FIG. 8 showing the mooring buoy detached from the vessel and supported by a line as if being retrieved to the ship.

FIG. 9A illustrates mooring buoy 162 detached from vessel 152 and supported by hawser 176, as if being retrieved to the ship. Fluid swivel 154 has been moved aside on trolley 186. A fixed retrieval guide unit 177 centers line 176 and provides for centralized alignment of pulling head 182 as buoy 162 approaches vessel bottom 166. Retrieval guide unit 177 includes a central guide sleeve 179 and rubber shock absorber elements 178 to allow impact loading by pulling head 182. Guide sleeve 179 and shock absorbers 178 are disposed within a cylindrical guide housing 180. Guide housing 180 has an upper flange 300 that vertically supports retrieval guide unit 177 on connector cover 191 when installed. Retrieval guide unit 177 is secured in place by guide latches 181, which are ideally fastened to connector cover 191. After buoy 162 is fully connected, retrieval guide 177 is removed in preparation for lifting conductors 169, 171, and 173 toward swivel 154.

Figure 9B:
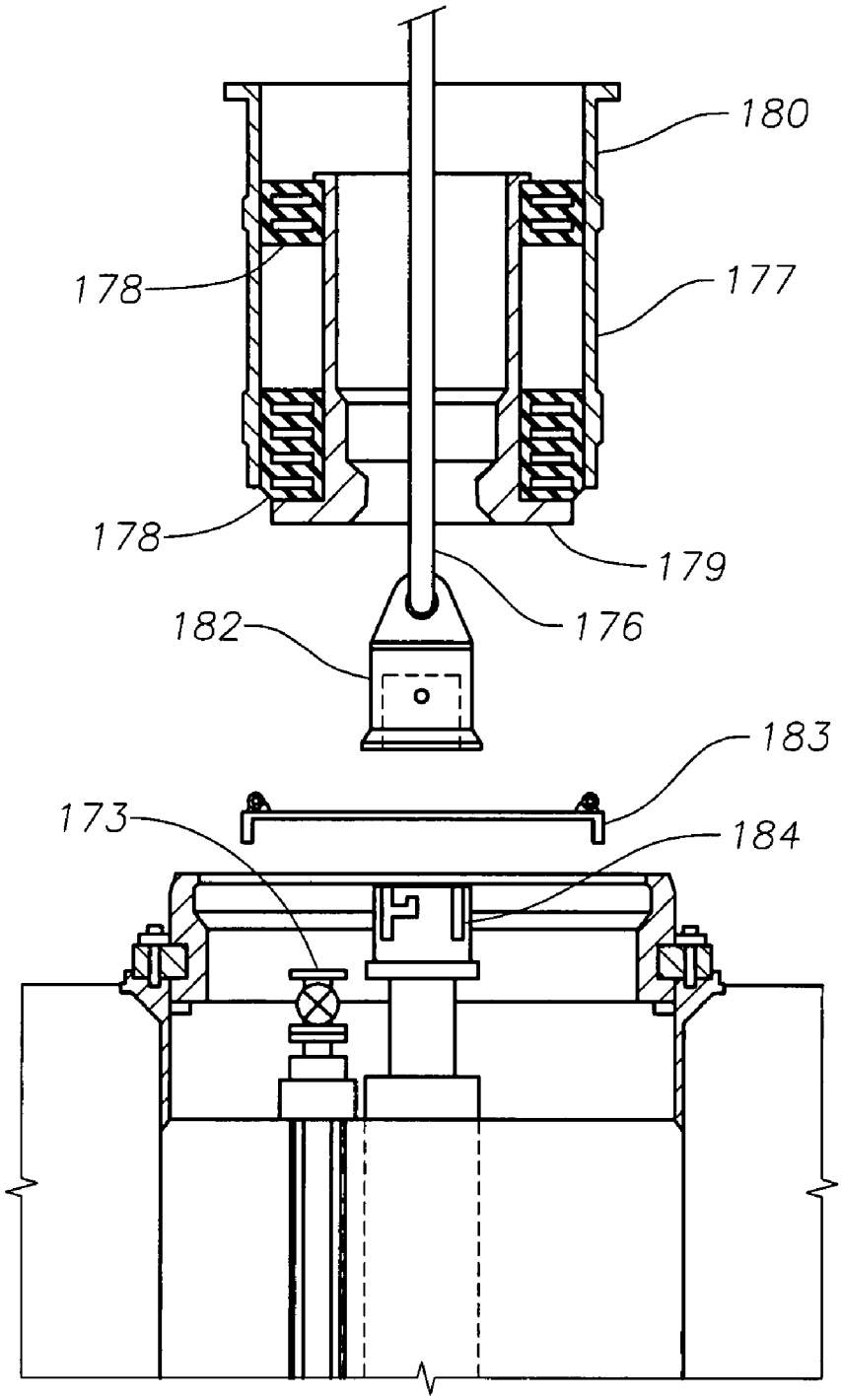
FIG. 9B depicts in partial cross section an array of parts to be assembled onto the mooring buoy prior to disconnection from the vessel.

FIG. 9B depicts the array of parts to be assembled onto buoy 162 prior to buoy disconnection. After torque tube 158 is retracted from engagement with center post 184 (see FIG. 8), cover 183 is lowered into position on post 184. Pulling head 182 with attached line 176 is then lowered and locked onto post 184.

Figure 10A:
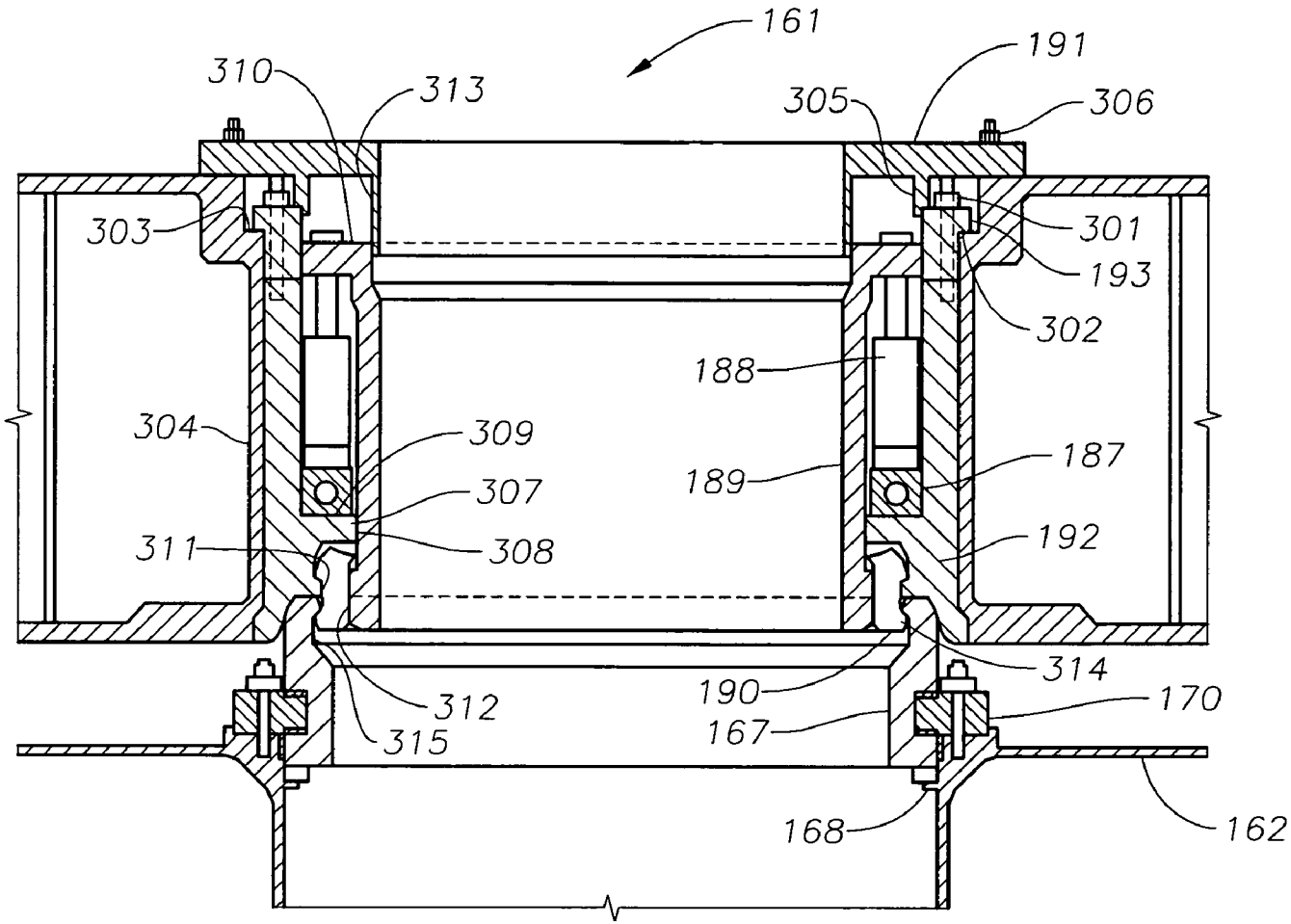
FIG. 10A is an enlarged side view cross section of the structural connector and buoy bearing assembly of FIG. 8, showing the structural connector connected to the buoy bearing hub.
Figure 10B:
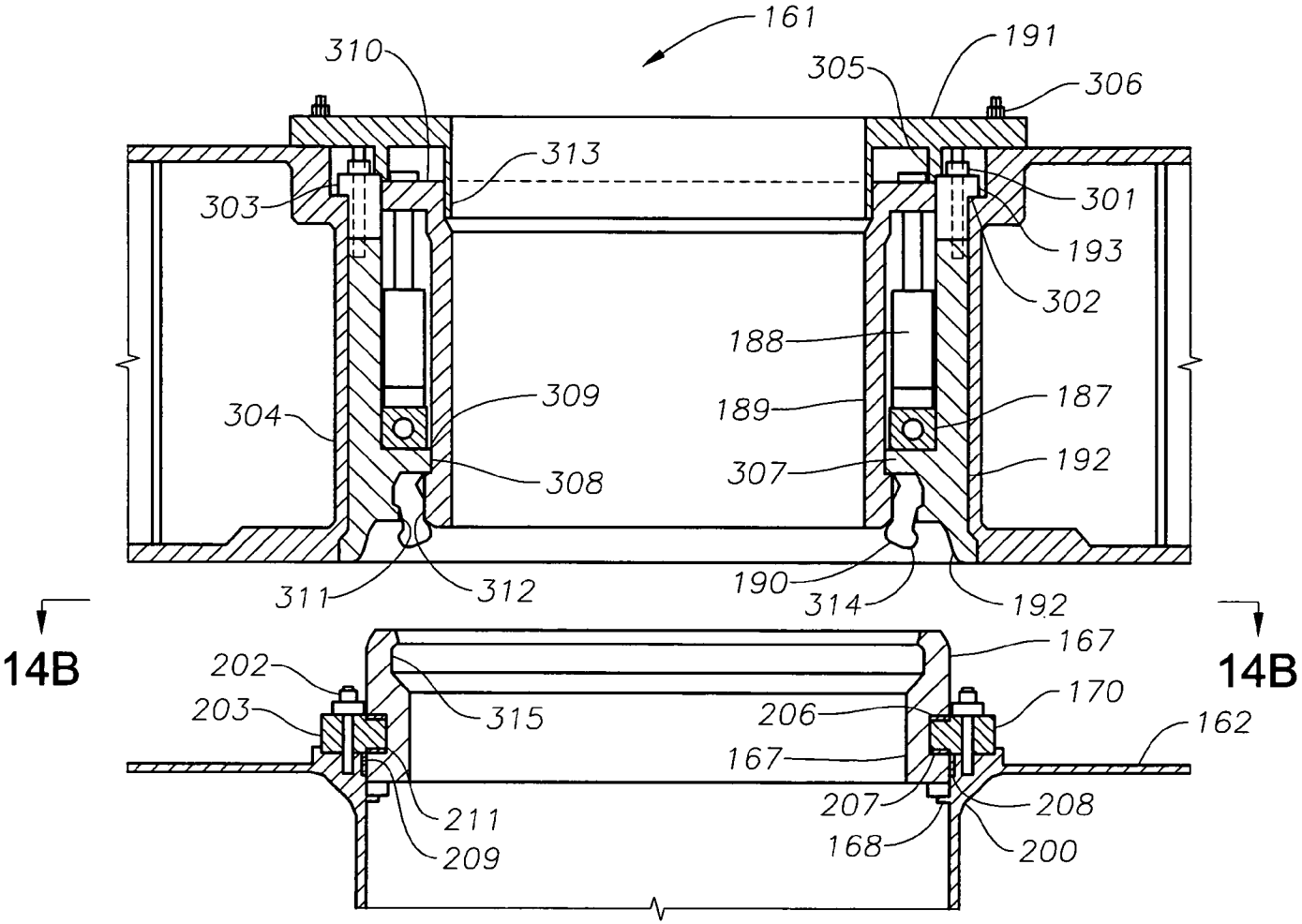
FIG. 10B is an enlarged side view cross section of the structural connector and buoy bearing assembly of FIG. 8, showing the structural connector disconnected from the buoy bearing hub.
Figure 11:
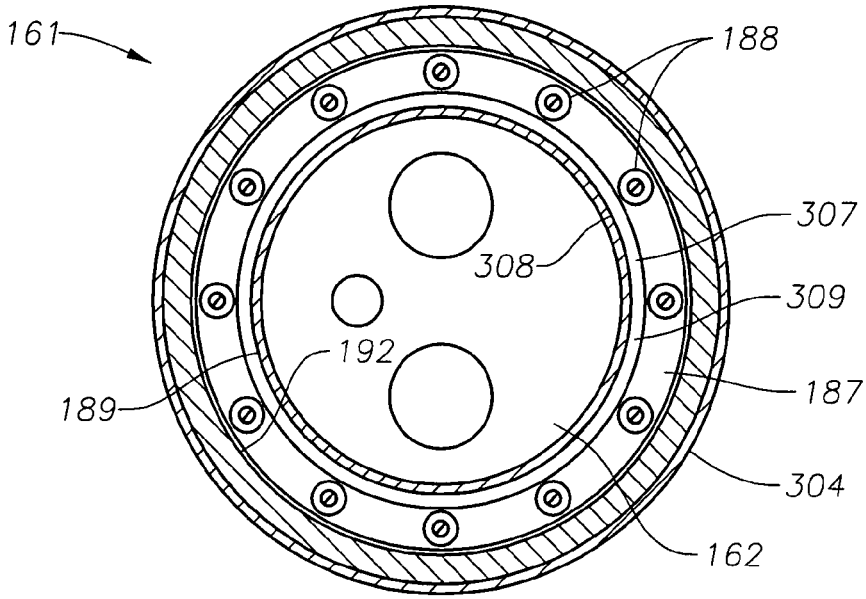
FIG. 11 is a cross section view taken along lines 11-11 of FIG. 8 looking down on the mooring buoy and showing a circumferential arrangement of hydraulic actuators that operate the structural connector.
Figure 12:
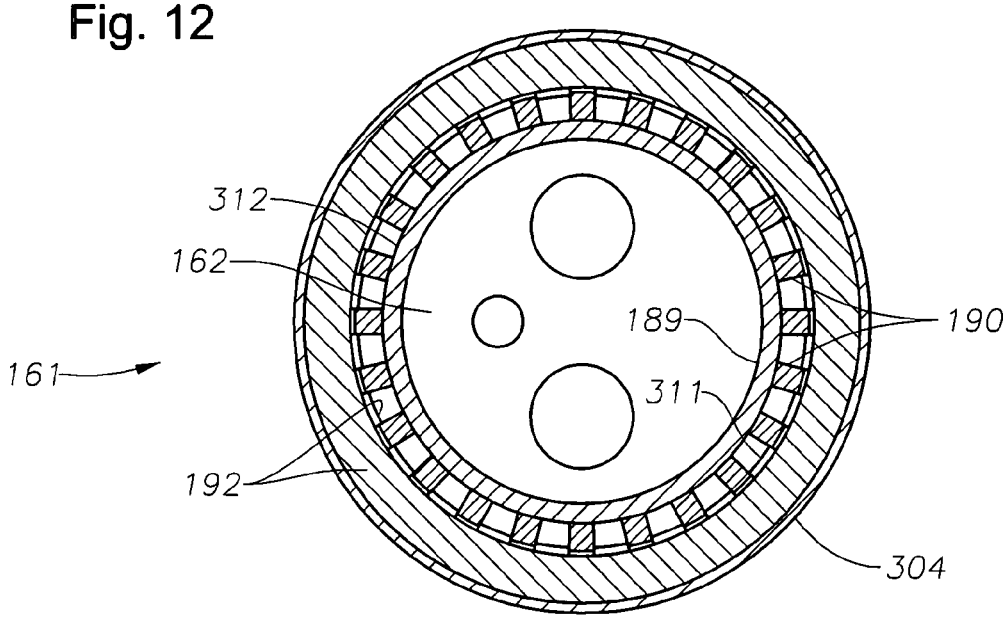
FIG. 12 is a cross section view taken along lines 12-12 of FIG. 8 looking down on the mooring buoy and showing a circumferential arrangement of collet segments of the structural connector.

FIGS. 10A and 10B are enlarged side view cross sections of structural connector 161 and buoy bearing assembly 170, connected and disconnected respectively, and FIGS. 11 and 12 are top view cross sections of structural connector 161 looking down at lines 11, 12 of FIG. 8. Structural connector 161 preferably includes a cylindrical connector housing 192 connected to a cylindrical retainer ring 193 by bolts 301. Retainer ring 193 includes an upper flange 302 that vertically supports structural connector 161 on a lip 303 of a cylindrical vessel structural bulkhead 304. Housing 192 is secured in place by a cylindrical rim 305 that extends downwardly from connector cover 191, which in turn is bolted to the cylindrical vessel bulkhead 304 by bolts 306. Housing 192 has an integral internal shelf 307 formed therein, the interior circumference 308 of which acts as a lower guide for movable connector sleeve 189 to slide axially therein. Connector cover 191 includes a downwardly extending ring 313 that fits within the interior of connector sleeve 189 and provides an upper guide for connector sleeve 189 to slide within.

The upper surface 309 of housing shelf 307 supports a circular hydraulic pressure manifold 187 thereon. Manifold 187 supplies pressurized hydraulic fluid to a plurality of hydraulic piston/cylinder actuators 188 that are circumferentially arranged about connector sleeve 189 and seated on manifold 187. Preferably, twelve actuators 188 are used, but any suitable number may be used. The upper ends of actuators 188 are connected to connector sleeve 189 at an integral external upper flange 310. Below shelf 307, a plurality of circumferentially arranged collet segments 190 are captured between a lower interior lip 311 of housing 192 and a lower exterior lip 312 of connector sleeve 189. Ideally, two dozen collet segments 190 are used, but any suitable number may be used.

Each collet segment 190 has a profile that vertically captures it between lips 311, 312 of connector housing 192 and connector sleeve 189, respectively, yet forces the lower end of the collet segment 190 to pivot radially in and out as connector sleeve 189 is moved up and down axially within housing 192 by actuators 188. The lower end of each collet segment 190 has a radially-outward facing lip 314 that engages an interior groove 315 of buoy bearing hub 167. Thus, when connector sleeve 189 is moved downwardly, lip 312 forces the lower ends of collet segments 190 to pivot radially outward, thereby securely dogging buoy bearing hub 167 against housing 192. Alternatively, when connector sleeve 189 moves upwardly, the lower ends of collet segments 190 pivot radially inward, thereby disconnecting bearing hub 167 from the vessel.

Although connector 161 is described and illustrated herein as being generally cylindrical, it is not limited to a cylindrical configuration. For example, octagonal, hexagonal, or even a square-shaped structural connector 161 may be used. Also, although the movable connector sleeve 189 is preferred to be coaxially disposed within housing 192, it may be disposed coaxially outside of housing 192, if desired.

Bearing hub 167 is rotatively captured by buoy bearing assembly 170 so that hub 167 can rotate with respect to buoy 162 when the buoy is connected to the seabed and the hub 167 is connected to the connector 161. A water seal 168 prevents water ingress into the structural connector compartment after the buoy 162 is connected to the vessel.

Figure 13:
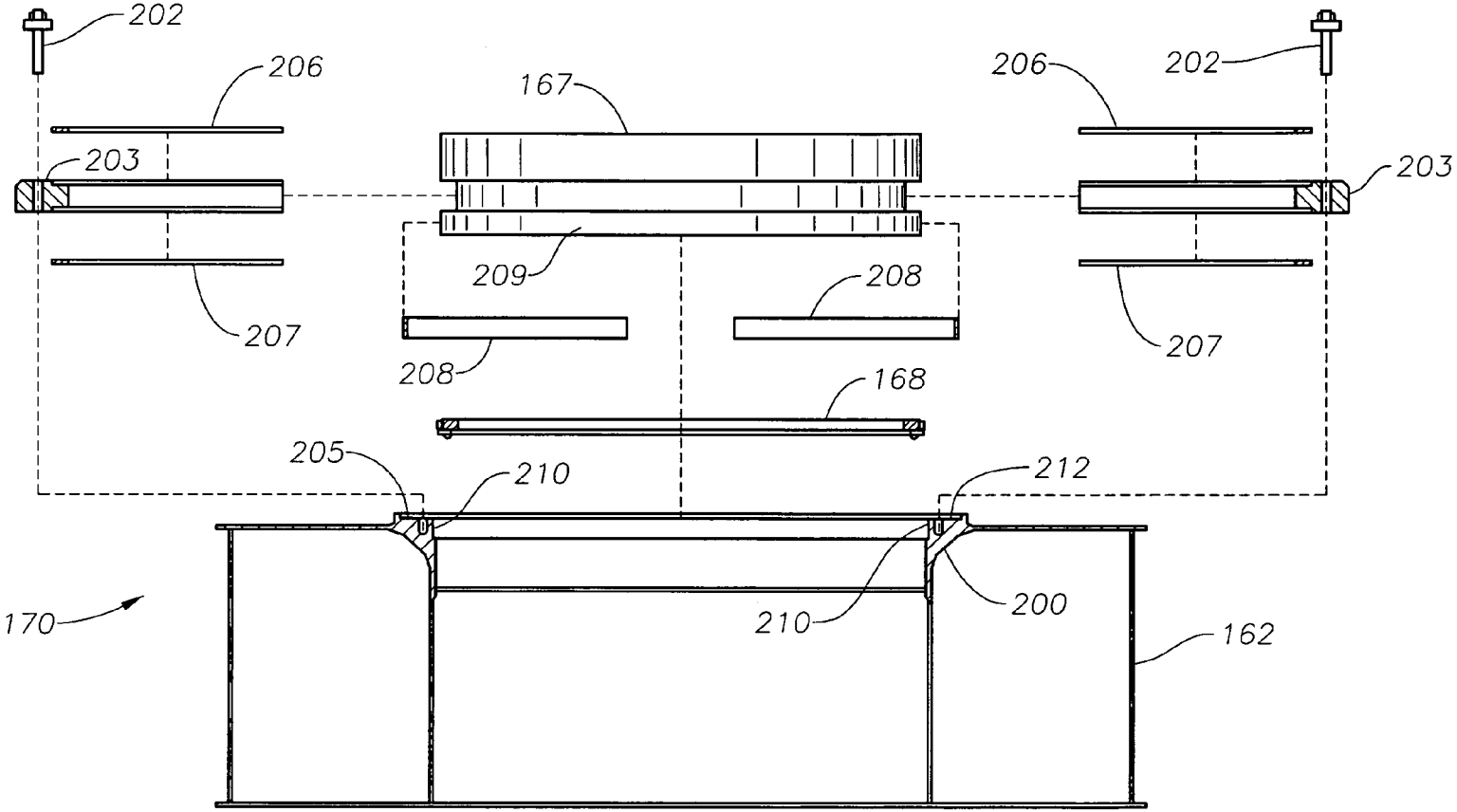
FIG. 13 is an enlarged side view exploded diagram of the buoy bearing assembly of FIG. 8 as it would be installed on the buoy.
Figure 14A:
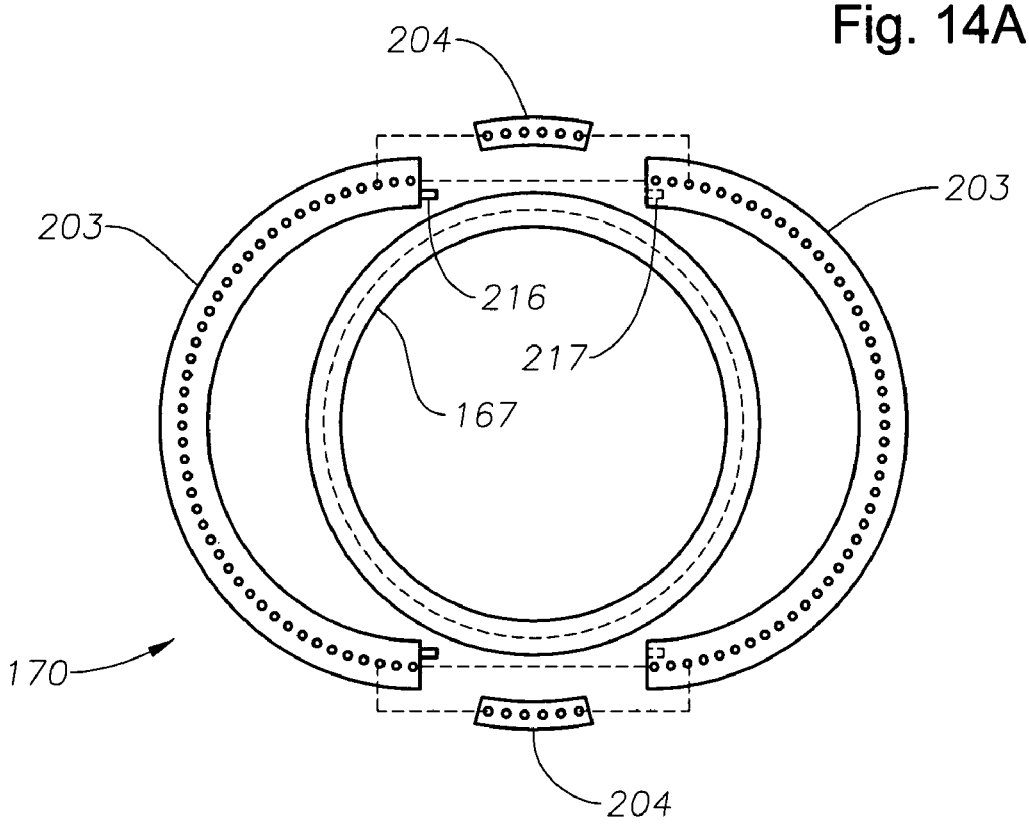
FIG. 14A is an enlarged top view exploded diagram of the buoy bearing assembly of FIG. 8 showing a segmented ring and bearing hub.
Figure 14B:
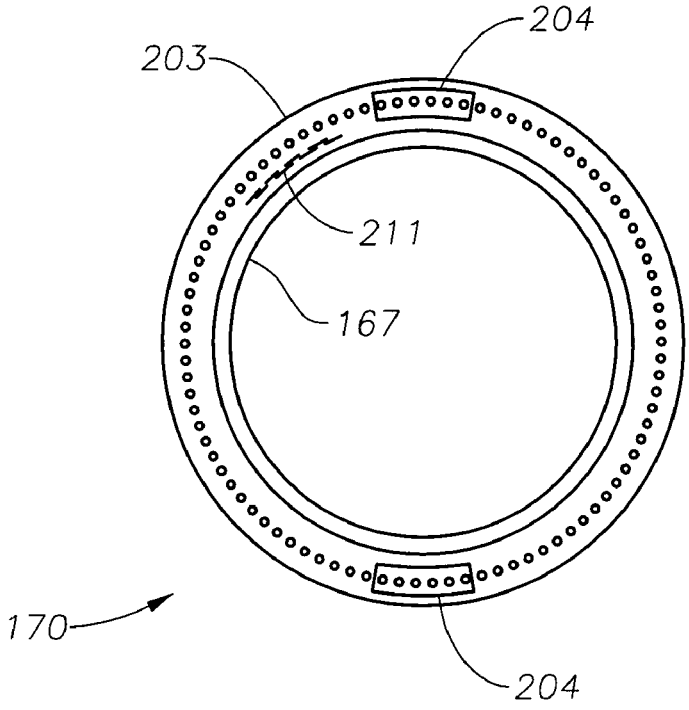
FIG. 14B is an enlarged top view of completed assembly of FIG. 14A showing the segmented bearing ring assembled on the bearing hub.

FIG. 13 is an enlarged side view exploded diagram illustrating buoy bearing assembly 170 as it is completely constructed for installation on buoy 162. FIG. 10B shows a side view cross section of the assembled and mounted bearing assembly 170 of FIG. 13. FIGS. 14A and 14B are a top view exploded diagram and a plan view of bearing assembly 170, respectively. Referring to FIGS. 10B, 13, 14A, and 14B collectively, bearing hub 167 is rotatively captured in a tongue and groove arrangement by bearing ring 203. Bearing hub 167 slidingly rotates within segmented bearing ring 203 by means of upper and lower axial bushing segments 206, 207 and radial bushing segments 208. Upper and lower bushing segments 206, 207 are captured between bearing ring 203 and bearing hub 167. Bearing ring 203 is manufactured in segments and is dimensioned so that when the segments are assembled they form a true circular ring that fits closely into pilot bore 205 (FIG. 13) yet allow a circumferential gap 211 (FIG. 10B) between bearing ring 203 and bearing hub 167. Gap 211 minimizes any sliding contact between hub 167 and ring 203 even after wear of radial bushing 208. Bearing ring segments 203 preferably include alignment pins 216 and alignment pin holes 217 (FIG. 14A) to maintain proper alignment during assembly. Joining plates 204 are used to hold bearing ring segments 203 together during assembly, and they also assure alignment and flatness at the segment joints within bearing ring 203. Radial bushing segments 208 circumferentially fit outside the lower portion of bearing hub 167 at radial bushing 209 and fit within radial bushing seat 210 of the bearing module 200 on buoy 162. Bushing segments 206, 207, 208, 209 are preferably made of non-metallic low-friction bushing material, such as Orkot brand or a similar material. Such materials are readily available for submerged service exposed directly to the seawater. The sliding bearing surfaces of bearing ring 203, bearing hub 167, and bearing module 200 that are in contact with bushing segments 206, 207, 208, and 209 are made of non-corrosive wear resistant materials such as stainless steel or Inconel. Grease suitable for use in salt water may advantageously be applied between bushings 208, 209 and between segments 206 and 207 and surfaces of hub 167. Bearing assembly 170 is mounted to the bearing module 200 on buoy 162 by threaded studs or other fasteners 202.

An advantage of the bearing assembly 170 is the prevention of radial loading of the studs 202. The radial load path passes directly through the radial bushing seat 210, radial bushing segment 208 and segment 209 of bearing hub 167. Segmented bearing ring 203 carries only the axial forces and moment loads acting on buoy 162. A second advantage is minimization of weight of the bearing components by providing a two-or-more-piece segmented bearing ring 203. This feature eliminates additional bolted or keyed joints that require additional parts.

Although a bearing assembly 170 is described where bearing ring 203 forms the tongue and bearing hub 167 includes the groove in the tongue and groove capturing arrangement, an opposite bearing arrangement may be used. In other words, bearing hub 167 may have a circumferential tongue (not illustrated) instead of a circumferential groove, which is received into a groove (not illustrated) formed in the interior of bearing ring 203.

Figure 15:
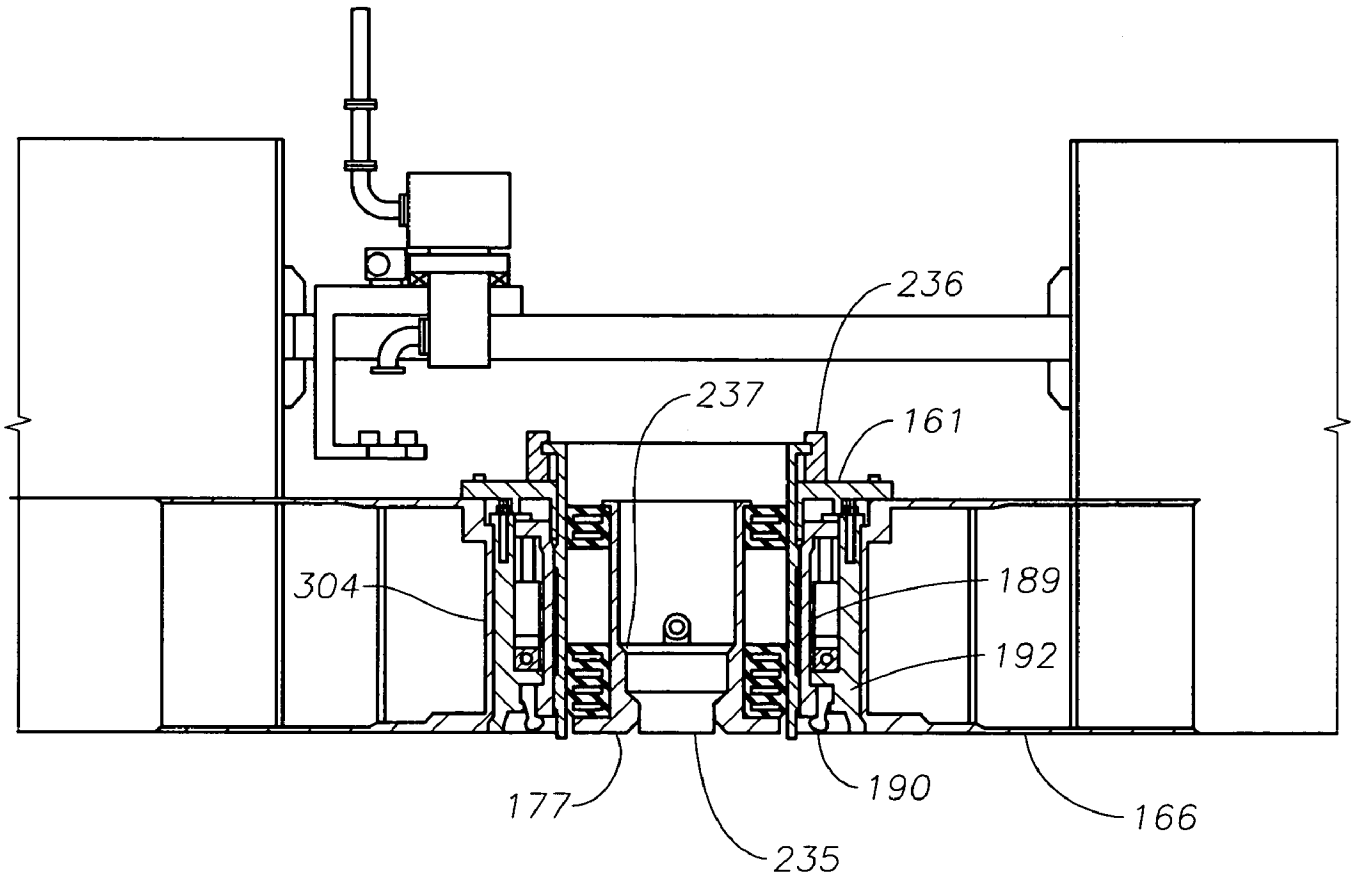
FIG. 15 is a side view in partial cross section of an arrangement for sealing the opening at the structural connector when the buoy is disconnected therefrom.

FIG. 15 shows an arrangement for sealing the central opening of connector 161 when buoy 162 is disconnected. Guide unit 177 remains in place inside connector sleeve 189 of structural connector 161. Guide unit 177 is raised to a position flush with the vessel bottom 166 and is secured by a guide latch 236. Plug 235 is lowered and secured into guide unit 177 to complete the flush bottom arrangement. Seal 237 around the upper circumference of plug 235 prevents water entry into the vessel FTS compartment. Other seals (not shown) prevent water entry through structural connector 161.

Figure 16:
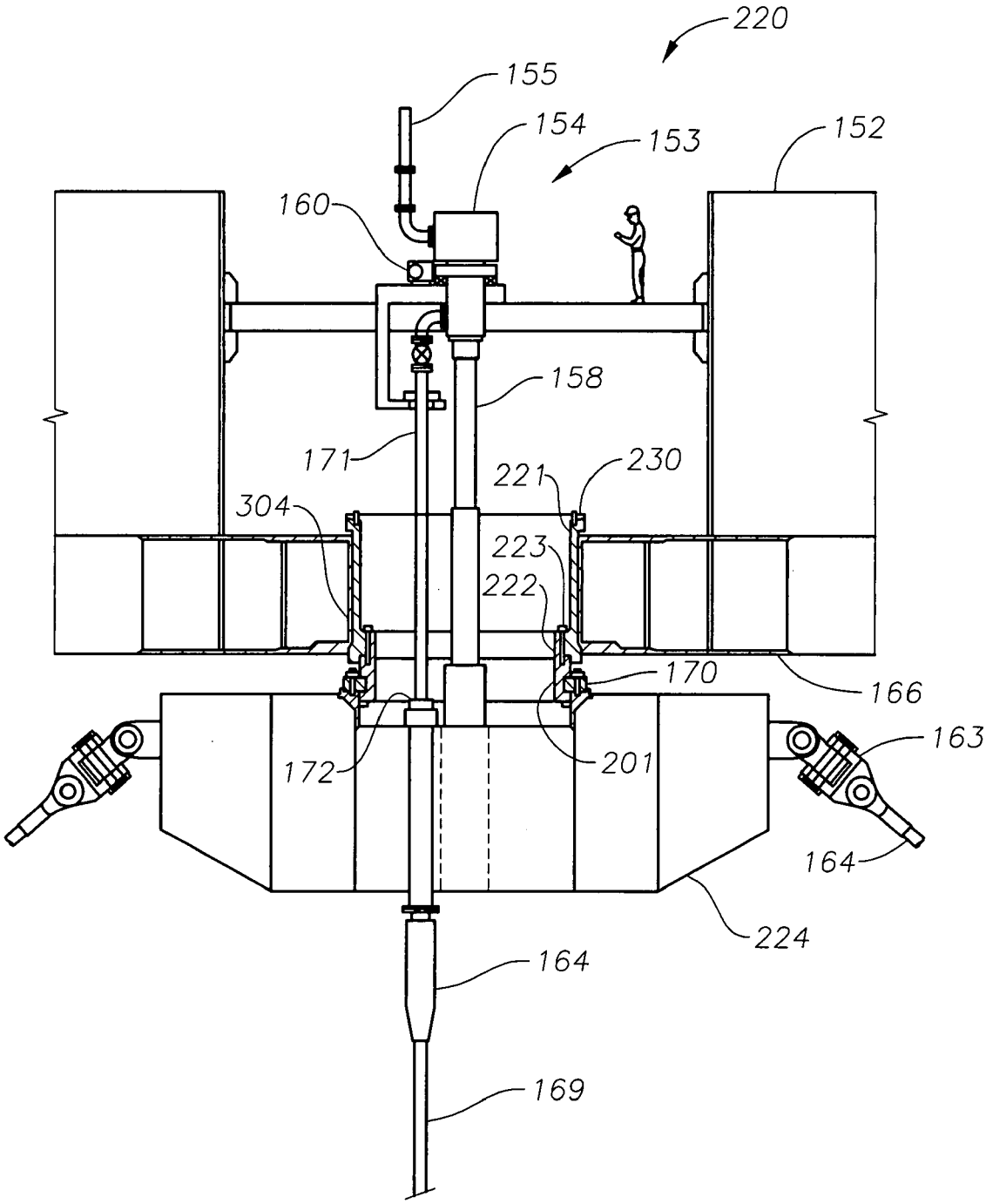
FIG. 16 is a side view in partial cross section of a mooring and fluid transfer system according to an alternative embodiment of the invention.

FIG. 16 illustrates a mooring and fluid transfer system 220 according to an alternative embodiment of the invention that is suitable for applications requiring only infrequent disconnection of the vessel 152 from the mooring buoy 224. A lower cost mooring system is provided by the arrangement of FIG. 16 as compared to that of FIG. 8, et al. Unlike the mooring and fluid transfer system 151 of FIGS. 8-15 having a quick-disconnect structural connector 161, the mooring and fluid transfer system 220 of FIG. 16 simply has a cylindrical connector member 221 that is fastened directly to bearing hub 201 of the disconnectable buoy 224 by fasteners 223. The fastener may be disconnected for separation of the buoy 224 from connector member 221 and vice-versa. Connector member 221 has a lower internal flange 222 that forms a seat for the upper end of bearing hub 201. A connector retaining ring 230 secures connector member 221 to the cylindrical vessel structural bulkhead 304. Bearing hub 201 of FIG. 16 is similar to bearing hub 167 of FIG. 10B, except that it substitutes a circumferential pattern of threaded holes along the top of the hub to receive threaded studs 223 in place of the internal groove 315 that is engaged by collet segments 190. Ideally, bearing assembly 170 is structured and functions identically for both embodiments. Buoy 224 supports the static weight of anchor legs 164, although in some cases it may be desirable and readily possible also to support the weight of fluid conductors 169 and fluid transfer system 153 on the buoy.

The Abstract of the disclosure is written solely for providing the United States Patent and Trademark Office and the public at large with a way to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A system for mooring a floating vessel (152) to a sea floor, comprising:

a buoy (162) in fixed position relative to said sea floor, the fixed position of said buoy (162) maintained by anchor legs (164) extending between said buoy (162) and said sea floor;

a buoy bearing assembly (170) having a fixed outer ring (203) and an inner hub (167), said fixed outer ring (203) non-movably attached to said buoy (162) whereby said outer ring (203) is fixed to the sea floor with said buoy;

said inner hub (167) revolvably coupled to said fixed outer ring (203) and configured to freely rotate with respect thereto; and a connector (161) disposed on said vessel (152) and arranged and designed to be releasably connectable to said inner hub (167);

whereby connection of said connector (161) to said inner hub (167) of said buoy bearing assembly (170) moors said vessel (152) to the sea floor while allowing said vessel to freely weathervane.

2. The system of claim 1 wherein said outer ring (203) includes at least two discrete segments disposed around said inner hub (167).

3. The system of claim 2, further comprising:

a radial bushing segment (208) circumferentially disposed about an exterior portion of said inner hub (167) that defines a radial sliding surface; and a radial bushing seat (210) formed in said buoy (162) and closely receiving said radial sliding surface of said inner hub (167);

whereby said radial bushing segment (208) reduces friction of said inner hub (167) rotating with respect to said radial bushing seat (210) when a force is applied in a radial direction between said inner hub (167) and said radial bushing seat (210), with radial loads between said buoy (162) and said vessel (152) moored thereto being transmitted through said inner hub (167), said radial bushing segment (208) and said radial bushing seat (210).

4. The system of claim 3 further comprising grease suitable for use in salt water placed between said radial bushing seat (210) and said sliding surface.

5. The system of claim 1 wherein said inner hub (167) is revolvably coupled to said outer ring (203) by a tongue and groove arrangement, said tongue and groove arrangement comprising a protrusion and a channel, the channel configured to envelop the protrusion.

6. The system of claim 5 further comprising, grease suitable for use in salt water placed between said inner hub and said outer ring in said tongue and groove arrangement.

7. The system of claim 5, further comprising:

an upper bushing segment (206) disposed between said inner hub (167) and said outer ring (203) in an interface between said tongue and groove in order that said upper bushing segment (206) reduces friction of said inner hub (167) rotating with respect to said outer ring (203) when a force is applied in an first axial direction between said inner hub (167) and said outer ring (203); and a lower bushing segment (207) disposed between said inner hub (167) and said outer ring (203) in an interface between said tongue and groove in order that said lower bushing segment (207) reduces friction of said inner hub (167) rotating with respect to said outer ring (203) when said force is applied in a second axial direction opposite said first axial direction between said inner hub (167) and said outer ring (203).

8. The system of claim 1 wherein:

said inner hub (167) has a circumferential outer surface and said outer ring (203) has an inner surface; and said inner hub (167) is revolvably coupled to said outer ring (203) by a tongue and groove arrangement, the tongue and groove arrangement comprising:

a protrusion extending radially inward from said inner surface of said outer ring (203); and a generally U-shaped channel defined by said outer surface of said inner hub (167).

9. The system of claim 1 wherein said connector (161) comprises a plurality of discrete collet segments (190) positioned circumferentially around a lower end of said connector (161) and arranged and designed to releasably secure said inner hub (167) to said vessel (152).

10. The system of claim 9 wherein said connector (161) further includes:

a housing (192) fixed to said vessel;

a sleeve (189) disposed coaxially in said housing (192), said plurality of collet segments (190) captured between said housing (192) and said sleeve (189); and an actuator (188) coupled to said sleeve and arranged and designed to move said sleeve (189) coaxially with respect to said housing (192);

whereby coaxial movement of said sleeve with respect to said housing forces said plurality of collet segments to move outwardly or inwardly.

11. The system of claim 1 wherein said connector (161) is fastened to said inner hub (167) by a plurality of fasteners.

12. The system of claim 11 wherein:

said connector (161) includes an internal flange (222); and said connector (161) is dimensioned to receive an upper portion of said inner hub (201) with abutment of a top surface of said inner hub (201) against said internal flange (222); and said connector (161) is fastened to said inner hub (201) by a plurality of bolts (223).

13. The system of claim 1 further comprising:

a first fluid conduit (155) disposed in said vessel (152) and fixed thereto;

a fluid swivel (154) disposed in said vessel (152) in fluid communication with said first fluid conduit (155); and a second fluid conduit (169) disposed between a fixture at the sea floor and said fluid swivel (154) and in fluid communication with said first fluid conduit (155) via said fluid swivel (154).

14. The system of claim 1 further comprising:

a retrieval guide unit (177) disposed in said connector (161) and including a guide housing (180), a shock absorber element (178) coupled to said guide housing, and a rounded centering guide sleeve (179) coupled to said shock absorber element (178);

whereby said retrieval guide unit provides for centralized alignment of a retrieval line (176) with attached pulling head (182) and allows for impact loading of said pulling head (182) during a mooring process.

15. The system of claim 14 further comprising:

a plug (235), having a circumferential sealing surface, arranged and designed to be received into said centering guide sleeve (179);

whereby said plug prevents water ingress into said vessel (152) through said centering guide sleeve (179).

16. A method of mooring a floating vessel (152) comprising the steps of:

mounting a buoy bearing assembly (170), characterized by having an inner hub (167) revolvably coupled to an outer ring (203), on a buoy (162) SO that said outer ring (203) is non-movably attached to said buoy (162);

submerging said buoy (162) with said buoy bearing assembly (170) fixed thereon and mooring said buoy (162) to a sea floor;

mounting on said vessel a structural connector (161) arranged and designed to be releasably connectable to said inner hub (167);

positioning said submerged and moored buoy (162) substantially adjacent the bottom of said vessel (152);

releasably connecting said structural connector (161) to said inner hub (167); and allowing said vessel (152) to weathervane about said buoy (162).

17. The method of claim 16 further comprising the steps of:

providing said structural connector (161) with a plurality of collet segments (190);

engaging said inner hub (167) by said plurality of collet segments (190); and dogging said inner hub (167) securely to said structural connector (161) by said plurality of collet segments (190).

18. The method of claim 16 further comprising the steps of:

rotatively receiving said inner hub (167) within a circular recess formed in said buoy (162), the perimeter of said recess defining a radial bushing seat (210), and transmitting a radial load between said vessel (152) and said buoy (162) through said radial bushing seat (210) and said inner hub (167).

19. The method of claim 16 further comprising the steps of:

disposing a fluid swivel (154) on said vessel (152);

fluidly coupling a first conduit (169) between a first fixture at said sea floor and a first port of said fluid swivel (154), said first conduit (169) generally held geostationary;

fluidly coupling a second conduit (155) between a second port of said fluid swivel (154) and a second fixture on said vessel (152); and transmitting a fluid between said first fixture and said second fixture via said first conduit (169), said fluid swivel (154), and said second conduit (155).

* * * * *